United States Patent [19]

Davis et al.

[11] Patent Number: 4,781,615

[45] Date of Patent: Nov. 1, 1988

[54] CABLE TERMINATING COVER RETENTION SYSTEM

[75] Inventors: Wayne S. Davis, Harrisburg; Jon A. Fortuna; Earl W. McCleerey, both of Mechanicsburg; Robert N. Whiteman, Jr., Middletown, all of Pa.

[73] Assignee: AMP Incorporated, Harrisburg, Pa.

[21] Appl. No.: 90,296

[22] Filed: Aug. 31, 1987

[51] Int. Cl.[4] ..... H01R 4/24

[52] U.S. Cl. ..... 439/395; 439/417

[58] Field of Search ..... 439/391–426

[56] References Cited

U.S. PATENT DOCUMENTS

| | | | |
|---|---|---|---|
| 3,434,093 | 3/1969 | Wederkind . | |
| 3,680,032 | 7/1972 | Mosier et al. . | |
| 3,816,818 | 6/1974 | Meier . | |
| 3,820,055 | 6/1974 | Huffnagle et al. . | |
| 3,820,058 | 6/1974 | Friend . | |
| 3,879,099 | 4/1975 | Shaffer . | |
| 4,062,616 | 12/1977 | Shaffer et al. . | |
| 4,068,912 | 1/1978 | Hudson, Jr. et al. . | |
| 4,077,695 | 3/1978 | Bakermans . | |
| 4,173,387 | 11/1979 | Zell . | |
| 4,208,083 | 6/1980 | Kirby | 439/395 |
| 4,209,219 | 6/1980 | Proietto . | |
| 4,420,211 | 12/1983 | Ledbetter . | |
| 4,496,207 | 1/1985 | Ensminger . | |
| 4,552,429 | 11/1985 | van Alst . | |
| 4,714,306 | 12/1987 | Meyazawa et al. | 439/395 |

*Primary Examiner*—Joseph H. McGlynn

*Attorney, Agent, or Firm*—David L. Smith

[57] ABSTRACT

A cable terminating cover retention system having two terminating covers (68, 70), each having leg means (72, 74) proximate the endwalls (90, 92) thereof, cooperate with an aperture (45) in a terminal support block (44) of connector housing (28). As conductors (56) are terminated on insulation displacement contacts (20) by moving the terminating covers (68, 70) toward the terminal support block (44), the leg means (72, 74) complement each other to substantially fill the aperture (45) and engage the sidewalls (102) of the apertures (45) in a first interference fit. As termination of the conductors (56) is completed, each leg means (72, 74) enters a recess or aperture (124, 126) in the other cable terminating cover (70, 68) and engages a protrusion (128, 130) therein in a second interference fit. The second interference fit is between the protrusion (128, 130) and an area (116) of the leg means (72, 74) not previously deformed by the first interference fit and retains the cable terminating covers (68, 70) in the terminated position.

18 Claims, 6 Drawing Sheets

CABLE TERMINATING COVER RETENTION SYSTEM

BACKGROUND OF THE INVENTION

This invention relates to connectors having cable terminated thereon and in particular to a cable terminating cover retention system in which an initial and final interference fit retention is obtained by different surfaces of the same feature.

U.S. Pat. No. 3,434,093 discloses a three member solderless connector for multiple conductor flat cable having a base, a body and a cap. Circular pegs extending from the cap are aligned with and forced into circularly cross-sectional channels in the body. The circularly cross-sectional channels pass through the body and are slightly constricted toward their midpoints to provide a retentative force fit securing the cap to the body and securing insulation piercing contacts within cavities in the body. Eliptically cross-sectional pins extend above the ends of the base, which are aligned with and are forced into eliptically shaped channels in the body. The eliptically shaped channels are adjacent the circularly shaped channels in the body. The eliptically shaped channels pass through the body and are slightly constricted toward their midpoints to provide a retentative force fit securing the base to the body with the terminated cable therebetween.

It would be desirable to have a cable terminating and cover retention system that would terminate two rows of conductors simultaneously with the retention system space requirements minimized.

SUMMARY OF THE INVENTION

In accordance with the present invention, a cable terminating cover retention system having two terminating covers, each having leg means proximate the ends thereof, cooperate with an aperture in a connector housing. As conductors are terminated on insulation displacement contacts by moving the terminating covers toward the connector housing, the leg means complement each other to substantially fill the aperture and engage the sidewalls of the aperture in a first interference fit. As termination of the conductors is completed, each leg means enters a recess or aperture in the other cable terminating cover and engages a protrusion therein in a second interference fit. The second interference fit is between the protrusion and an area of the leg means not previously deformed by the first interference fit and retains the cable terminating covers in the terminated condition.

DESCRIPTION OF THE PREFERRED EMBODIMENT

Figure 1:
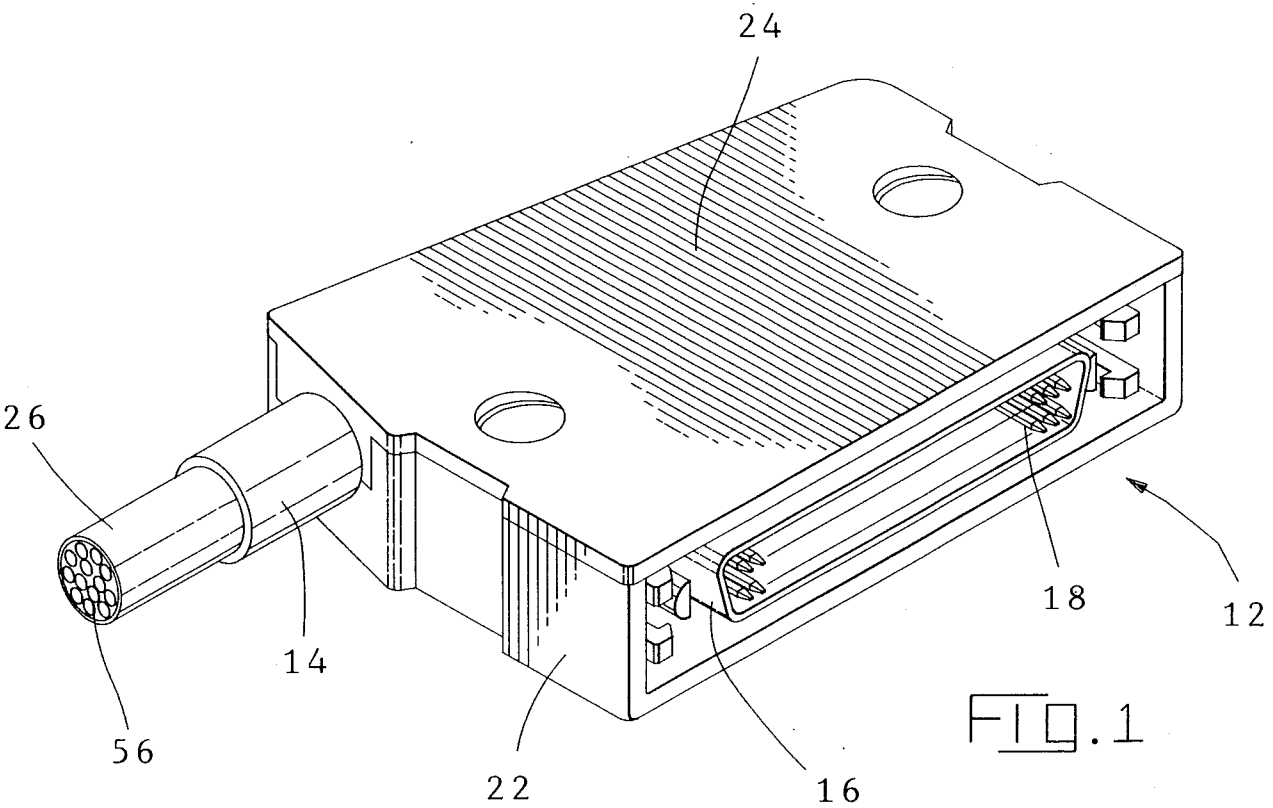
FIG. 1 is a perspective view of an electrical connector assembly in accordance with the present invention.

FIG. 1 depicts a perspective view of an electrical connector assembly 10 in accordance with the present invention. The presently preferred embodiment is a shielded plug connector 12 terminating a shielded multiple conductor cable 14. The invention has application to other connector assemblies such as unshielded connectors and receptacle connectors. Drawn shell 16 shields pin 18 of contacts 20 and engages shielding of a complementary connector (not shown). Drawn shell 16 is also electrically conductive with electrically conductive backshell 22 and backshell cover 24 which in turn are electrically conductive with conductive sheath 26 (see FIG. 7) of cable 14. Drawn shell 16 back shell 22 and cover 24 collectively provide means for shielding electrical connector assembly 10.

Elongate plug housing 28 is molded of thermoplastic having mating face 30, opposing rear face 32 and a plurality of contact receiving passages 34 extending therebetween. Mating face 30 may provide a polarization feature by having a trapezoidal or subminiature D shape. Shell 16 surrounds mating face and conforms to the shape of plug housing 28 forward of flanges 36. Shell 16 extends forward of mating face 30 and provides shielding for pins 18.

Figure 3:
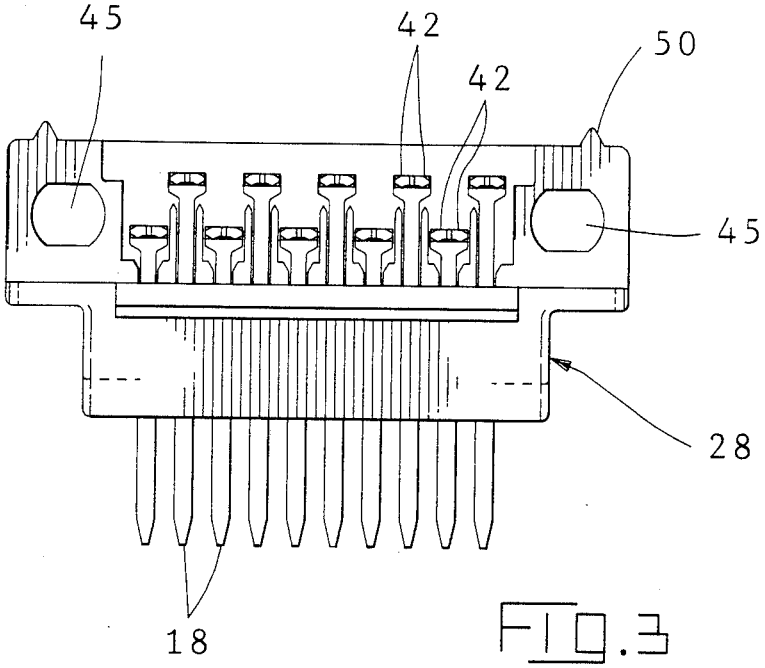
FIG. 3 is top view of the housing of FIG. 1 with contacts inserted therein.
Figure 4:
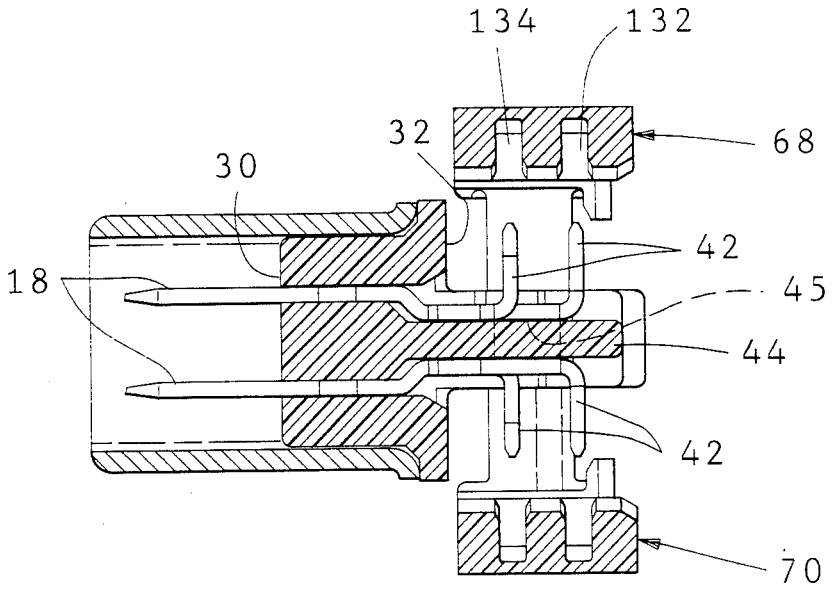
FIG. 4 is an end view of the housing of FIG. 3.
Figure 5:
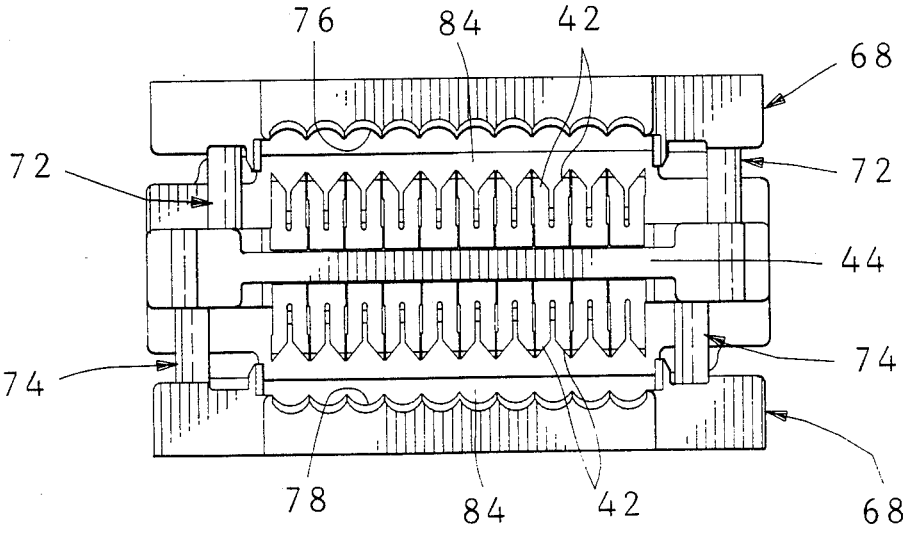
FIG. 5 is a rear view of the housing of FIG. 3 with terminating covers positioned to receive and terminate a cable.
Figure 6A:
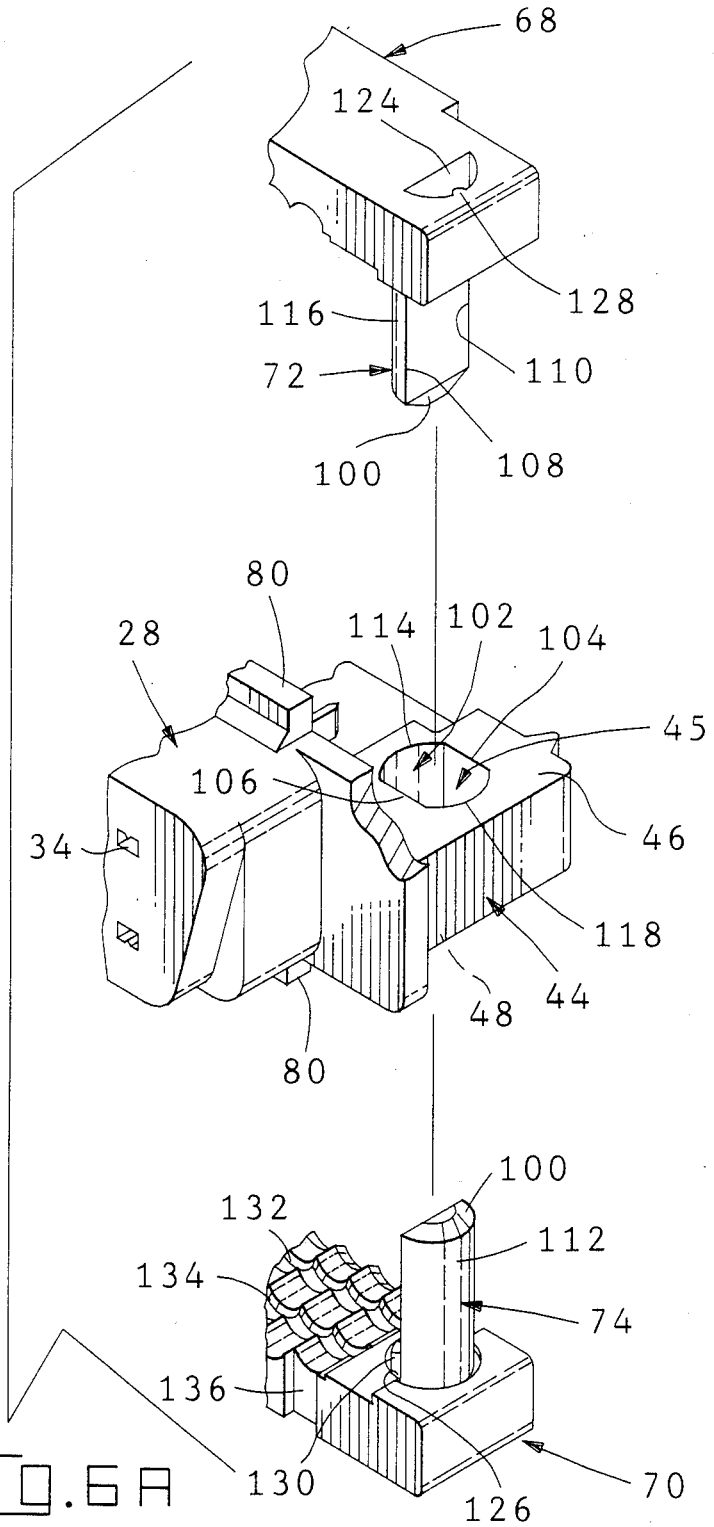
FIG. 6A is a perspective view of the terminating cover retention system prior to termination.
Figure 6B:
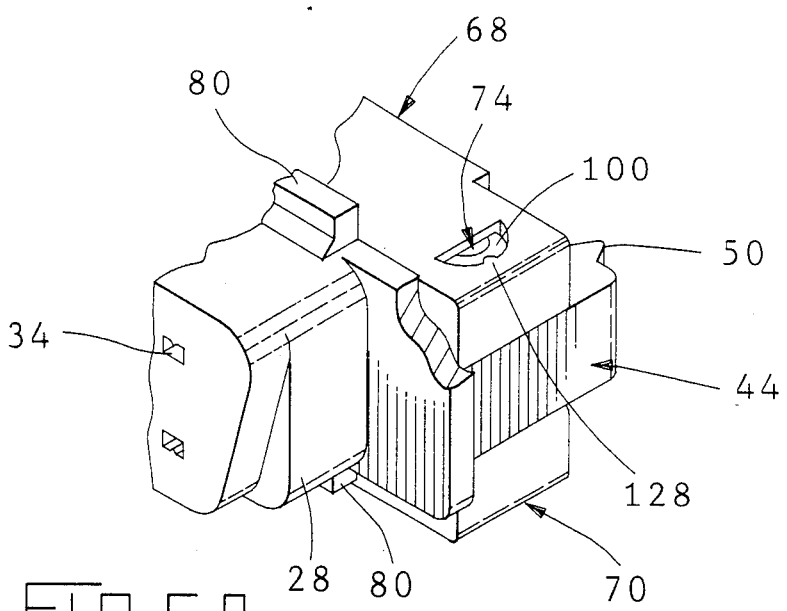
FIG. 6B is an enlarged perspective view of the terminating cover retention system subsequent to termination.

Contact receiving passages 34 are arranged in two rows and have contacts 20 secured therein. Contacts 20 include a central body portion 38 with a mating portion, shown in the presently preferred embodiment as pin 18, extending from a first side thereof. A terminating portion 40 extends from another side of body portion 38 and has on its free end a slotted insulation displacing plate 42 as is known in the art. Adjacent contacts 20 have terminating portions of different lengths so that the insulation displacing plates 42 form two parallel rows as best seen in FIG. 3 and 4. Contacts 20 are secured in contact receiving passages by barbs 39 which plow through the sidewalls of contact receiving passages 34 upon insertion and secure contacts 20 by engaging the sidewalls in an interference fit.

Terminal support block 44 extends rearward from rear face 32 between the two rows of contact receiving passages 34 for substantially the length of plug housing 28 and has apertures 45 at opposite ends thereof. Insulation displacing plates 42 extend upwardly from the upper surface 46 of block 44 for the upper row of contacts 20 and downwardly from the lower surface 48 of block 44 for the lower row of contacts 20. During termination of conductors 56, insulation displacing plates 42 bear on respective surfaces of block 44. Rearward extending protrusions 50 engage backshell 22 in an interference fit (see FIG. 7) to position plug housing 28 therein, to clamp flange 52 of shell 16 in engagement with backshell 22 establishing electrical continuity therebetween and to assure proper positioning of shell 16 so that shroud 54 extends forwardly of mating face 30 a predetermined distance.

Figure 2:
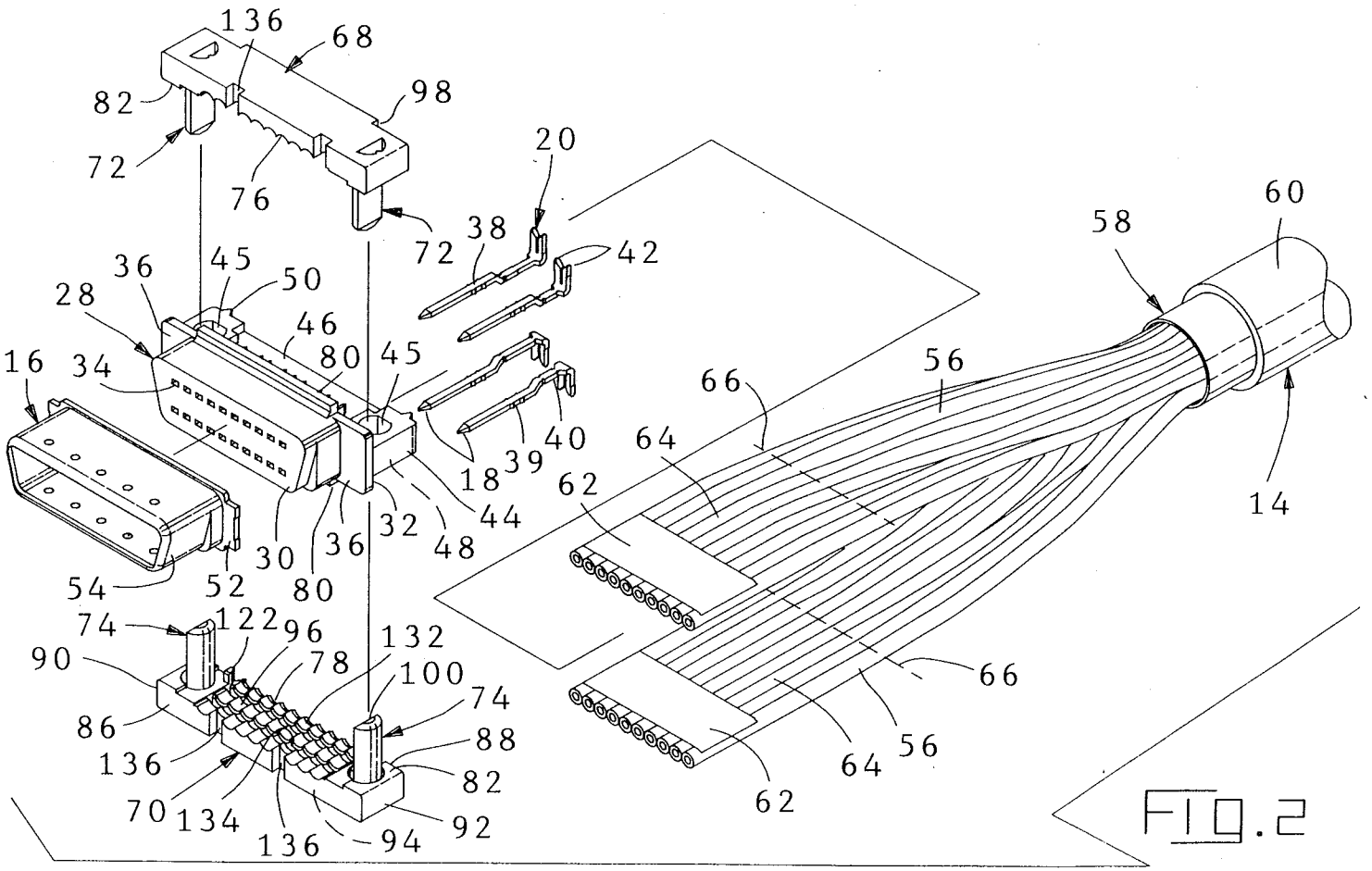
FIG. 2 is an exploded perspective view of the electrical connector assembly of FIG. 1 with the backshell and backshell cover removed.

A plug connector 12 in accordance with the present invention may terminate either ribbon cable or multiple conductor cable; the cable may be shielded or unshielded. Multiple conductor cable 14 is commercially available and has multiple insulated conductors 56 enclosed within a conductive sheath 26 of metal braid which surrounds a metal foil 58. Sheath 26 is contained in an outer jacket 60 of insulative material. An end of the cable 14 is stripped such that individual conductors 56 are exposed. The exposed individual conductors 56 are fanned out into an organized planar configuration resulting in a one-to-one known relationship between the location of conductors 56 on one end of a cable assembly relative to the location of the conductors 56 on the other end of the cable assembly. Conductors 56 are maintained in this organized planar configuration with spacing appropriate for terminating in plug housing 12 by an adhesive strip 62. Alternatively, conductors 56 are maintained in position by heat bonding or chemically bonding the insulation together. For terminating a single cable, two arrays may be formed, one for terminating to the upper row of contacts and the other for terminating to the lower row of contacts. It can be appreciated by those skilled in the art that a ribbon cable would have conductors spaced appropriately for terminating in insulation displacing plates 42 of plug connector 12 and a ribbon cable 64 may be represented by the conductors 56 in FIG. 2, absent adhesive strip 62, to broken line 66.

Upper and lower surfaces 46, 48 of block 44 are recessed through the region of contacts 20 to minimize the height of plug connector 12. Cable 14 is terminated by first preassembling upper terminating cover 68, plug housing 28 and lower terminating cover 70. Complementary shaped leg means 72 on upper terminating cover 68 and leg means 74 on lower terminating cover are axially aligned with apertures 45. Thence terminating covers 68, 70 are moved toward terminal support block 44 with leg means 72, 74 engaging the walls of apertures 45 in an interference fit, as will be discussed below, until fluted surfaces 76, 78 are spaced from insulation displacing plates 42 to receive conductors 56 therebetween. The conductors are then fed into the space 84 between the fluted surface 46, 48 and insulation displacement plates 42 until the ends thereof engage conductor stopping flanges 80. Flanges 80 extend from housing 28 and have a surface coplanar with rear face 32. The upper and lower terminating covers are then pressed toward each other until shoulders 82 seat against covers 68, 70 thus terminating conductors 56 in respective insulation displacing plates 42 in both rows of contacts 20.

Terminating covers 68, 70 are elongate having opposed sidewalls, 86, 88, opposed endwalls 90, 92 outer surface 94 and opposed inner surface 96, a portion of which forms fluted surfaces 76, 78. Sidewall 88 may have a ledge 98 which would provide polarization of covers 68, 70. Leg means 72, 74 extend from inner surface 96 proximate endwalls 90, 92 and are spaced to be received in apertures 45 and have tapered lead in ends 100.

The cross section of leg means 72, 74 on terminating covers 68, 70 complement each other to substantially fill aperture 45 and provide an interference fit with sidewall 102. In a preferred embodiment, leg means 72, 74 have a cross-section that is a chordal section of a circle, such as a semicircle; aperture 45 is circular with two flat sides 104, 106.

Upon assembling covers 68, 70 to housing 28 in a predetermined position, leg means 72 of cover 68 are received in apertures 45 from upper surface 46 with corner 108 engaging flat side 106 in an interference fit and with corner 110 engaging flat side 104 in an interference fit. The remaining cylindrical surface 116 slides along arcuate surface 114 of sidewall 102. Leg means 74 of cover 70 are received in apertures 45 from lower surface 48 and functions in a similar manner with the corners engaging flat sides 104, 106 in an interference fit and cylindrical surface 112 sliding along arcuate surface 118. The respective chordal surfaces of leg means 72, 74 in aperture 45 slide past each other.

Terminating covers 68, 70 are preassembled with fluted surfaces 76, 78 spaced from insulation displacing plate 42 to receive a planar array of conductors 56 therebetween. Conductors 56 are inserted abut flanges 80 which provides a stop and prevents conductors 56 from engaging shell 16. Fluted surfaces 76, 78 assist in properly positioning conductors 56 for termination. Stops 122 (see FIG. 2) adjacent each end of fluted surfaces 76, 78 prevent conductors 56 from being displaced transverse to the axis of conductors 56 being terminated.

Subsequent to inserting conductors 56, a termination force is applied to terminating covers 68, 70, such as with a press or hand tool, to terminate conductors 56 on terminating portion 40 of contacts 20 in both rows. Simultaneously, leg means 72, 74 penetrate farther into apertures 45 and the leading end of leg means 72 on terminating cover 68 enters aperture 126 on terminating cover 70 while the leading end of leg means 74 on terminating cover 70 simultaneously enters aperture 124 on terminating cover 68. Aperture 124 is adjacent leg means 72 on terminating cover 68 and receives leg means 74 from terminating cover 70 in an interference fit. The interference fit is achieved by leg means 74 on terminating cover 70 engaging rib 128 which protrudes into aperture 124. The interference fit in the terminated position engages rib 128 in aperture 124 of terminating cover 68 against a surface 112 of leg means 74 on cover 70 that was not previously deformed. Aperture 126 is adjacent leg means 74 on terminating cover 70 and receives leg means 72 from terminating cover 68 in an interference fit. The interference fit is achieved by leg means 72 on terminating cover 68 engaging rib 130 which protrudes into aperture 126. The interference fit in the terminated position engages rib 130 in aperture 126 of terminating cover 70 against a surface 116 of leg means 72 on terminating cover 68 that was not previously deformed.

During termination, leg means 72, 74 cooperate with aperture 45 to maintain proper orientation of terminating covers 68, 70 relative to plug housing 28 and insulation displacement plates 42 assuring that terminating covers 68, 70 move along a path orthogonal to surfaces 46, 48. This assures proper insulation displacement termination of conductors 56 as the insulation is pierced perpendicular to the plane of the array of conductors 56. The free ends of insulation displacement plates 42 are received in apertures in terminating covers 68 and 70.

Although upper and lower terminating covers 68, 70 need not be identical, by making the apertures which receive the free ends of insulation displacement plates 42 continuous forming channels 132, 134 overcomes the staggering of adjacent contacts 20. This when combined with an arrangement and cross-section of leg means 72, 74, apertures 124, 126 and apertures 45, an example of which is disclosed herein, permits covers 68, 70 to be hermaphroditic, necessitating only one mold.

Terminating covers 68, 70 may have a vertical channel 136 in sidewall 86 adjacent conductor stopping flanges 80 for visual inspection to determine whether conductors 56 are inserted to a depth sufficient for proper termination.

Figure 7:
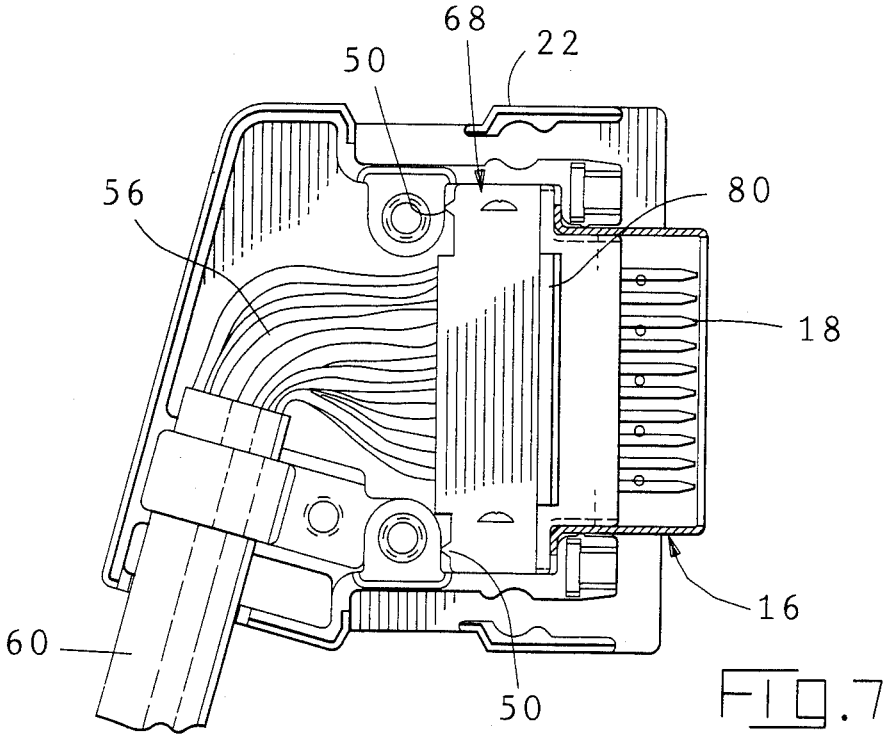
FIG. 7 is a top view of the backshell showing a cable strain relief.
Figure 8:
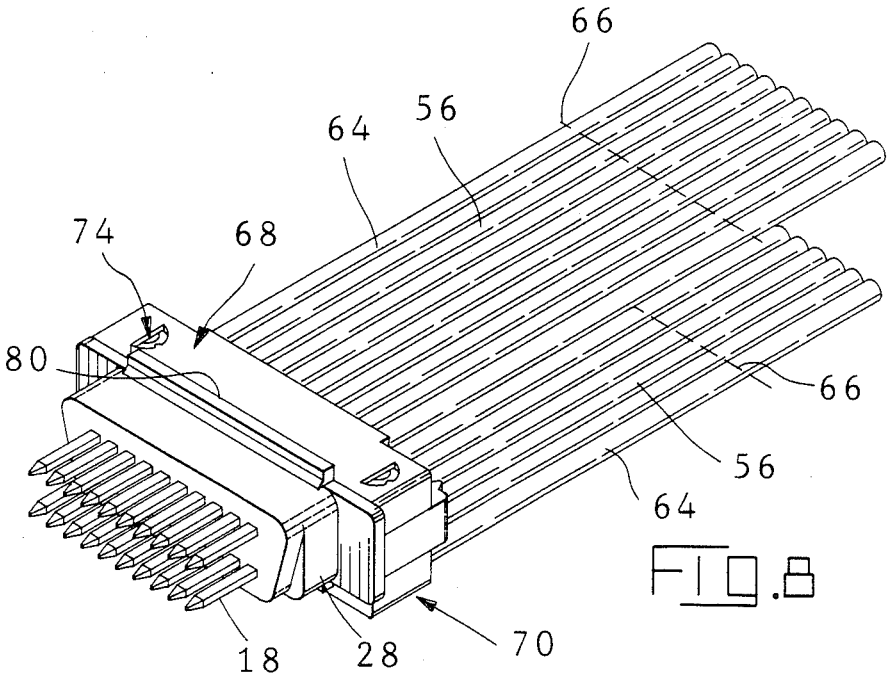
FIG. 8 is a perspective view of a plug housing with a cable terminated thereto.

Electrical connector assembly 10 may be terminated to one or both ends of a cable 14 forming a cable assembly. Either of FIGS. 7 or 8 illustrate one end of such a cable assembly.

We claim:

1. An electrical connector assembly for terminating a cable having a plurality of insulated conductors disposed in a planar array, the assembly capable of being preassembled into a pretermination position to permit insertion and alignment of said cable for termination thence terminated to the cable defining a termination position, comprising:

a dielectric housing having a mating face and an opposed rear face with a plurality of contact receiving passages disposed in two rows extending therebetween with contacts secured therein, said contacts having an axis, a mating portion proximate said mating face and a terminating portion extending beyond said rear face, said terminating portion formed to be an insulation displacing plate having a slot therein extending normal to the axis of said contact, a terminal support block extending from the rear face of said housing between the rows of contacts, said block having a pair of apertures therethrough defining aperture walls;

a first cable terminating cover having spaced first leg means extending normally thereof with first aperture means adjacent thereto, said first aperture means defining first wall means, said first leg means adapted to be received in said pair of apertures at a pretermination position in an interference fit between a first portion of said first leg means and a first portion of said aperture walls;

a second cable terminating cover having spaced second leg means extending normally thereof with second aperture means adjacent thereto, said second aperture means defining second wall means, said second leg means adapted to be received in said pair of apertures from an opposed direction from said first leg means, said second leg means adapted to be received in said pair of apertures at a pretermination position in an interference fit between a first portion of said second leg means and a second portion of said aperture walls, said second leg means adapted to be secured in said apertures at a termination position with said second leg means extending into said first aperture means in an interference fit between a second portion of said second leg means and said first wall means, said first leg means adapted to be secured simultaneously with said second leg means, said first leg means adapted to be secured in said apertures at a termination position with said first leg means extending into said second aperture means in an interference fit between a second portion of said first leg means and said second wall means, whereby the interference fit that secures the cable terminating covers in the cable terminated position is between a wall means and an area of the leg means not previously deformed by the interference fit that retains the cable terminating covers in the pretermination position.

2. A cable assembly as recited in claim 1 wherein the apertures through said terminal support block are normal to the axis of said contacts.

3. A connector assembly as recited in claim 1 wherein the first cable terminating cover further comprises a rib on said first wall means extending into said first aperture means, whereby the interference fit that secures the second cable terminating cover in the termination position is an interference between a second portion of said second leg means and the rib.

4. A connector assembly as recited in claim 1 further comprising means for shielding said housing.

5. A connector assembly as recited in claim 1 further comprising aperture means in said first cable terminating cover, said aperture means adapted to receive the insulation displacing plate.

6. A connector assembly as recited in claim 1 wherein said first and second terminating covers are hermaphroditic.

7. A connector assembly as recited in claim 1 further comprising cable stop means extending from said housing, said cable stop means adapted to engage ends of conductors positioned in the connector assembly for termination thereto.

8. A connector assembly as recited in claim 7 wherein the cable stop means is coplanar with said rear face.

9. A connector assembly as recited in claim 1 wherein a cross-section of the first leg means is a chordal section of a circle.

10. A connector assembly as recited in claim 9 wherein the chordal section is a semicircle.

11. A system of opposed members for clamping a plurality of conductors therebetween, comprising:

a first clamping member having spaced first leg means extending normally thereof with first aperture means adjacent thereto, said first aperture means defining first wall means, said first clamping member defining a surface to engage the conductors;

a second clamping member having spaced second leg means extending normally thereof with second aperture means adjacent thereto, said second aperture means defining second wall means, said second clamping member defining a surface to engage the conductors, said second leg means adapted to be received in said first aperture means in an interference fit between a first portion of said second leg means and said first wall means, said first leg means adapted to be received in said second aperture means in an interference fit between a first portion of said first leg means and said second wall means, whereby when the conductors are received between the spaced first and second leg means, and between the first and second clamping members, with the respective leg means received in respective aperture means, the first and second clamping members are thereby secured together, clamping the conductors therebetween.

12. A system as recited in claim 11 wherein said first and second clamping members are hermaphroditic.

13. A system as recited in claim 11 wherein said conductor engaging surface of said first clamping member is fluted.

14. A system as recited in claim 11 wherein the first clamping member further comprises a rib on said first wall means extending into said first aperture means, said rib adapted to interfere with a portion of said second leg means, whereby the interference fit therebetween further secures said first and second clamping members together.

15. A system as recited in claim 11 wherein said first clamping member further comprises conductor stop means extending from said conductor engaging surface, said conductor stop means adapted to engage conductors positioned adjacent respective leg means.

16. A system as recited in claim 11 wherein the first aperture means has the same shape in a cross-section as a cross-section of the first leg means.

17. A system as recited in claim 11 wherein a cross-section of said first leg means is a chordal section of a circle.

18. A system as recited in claim 17 wherein the chordal section is a semicircle.

* * * * *